US008185990B1

(12) United States Patent
Newville

(10) Patent No.: US 8,185,990 B1
(45) Date of Patent: May 29, 2012

(54) SWIMMING POOL BRUSH WITH HYDROFOIL

(76) Inventor: Duane H. Newville, Clearwater, FL (US)

( * ) Notice: Subject to any disclaimer, the term of this patent is extended or adjusted under 35 U.S.C. 154(b) by 809 days.

(21) Appl. No.: 12/270,044

(22) Filed: Nov. 13, 2008

(51) Int. Cl.
*E04H 4/16* (2006.01)

(52) U.S. Cl. ..... 15/1.7; 15/246

(58) Field of Classification Search ..... 15/1.7, 15/171, 246; 210/167.2; 114/222; *E04H 4/16*
See application file for complete search history.

(56) References Cited

U.S. PATENT DOCUMENTS

| | | | | |
|---|---|---|---|---|
| 1,761,180 | A * | 6/1930 | Cave et al. | 15/117 |
| 2,407,421 | A * | 9/1946 | Herold | 403/58 |
| 4,035,863 | A | 7/1977 | Fischer | |
| 4,637,087 | A * | 1/1987 | Feinberg | 15/1.7 |
| 4,733,427 | A * | 3/1988 | Conrad | 15/160 |
| 4,763,377 | A * | 8/1988 | Madsen | 15/144.2 |
| 4,783,868 | A * | 11/1988 | O'Callaghan | 15/1.7 |
| D321,793 | S * | 11/1991 | Bryant | D4/135 |
| 5,551,115 | A * | 9/1996 | Newville | 15/172 |
| D549,465 | S * | 8/2007 | Hay et al. | D4/199 |
| 7,353,559 | B1 * | 4/2008 | Blackwell | 15/1.7 |
| 2003/0102009 | A1 * | 6/2003 | Fortier | 134/6 |
| 2004/0060129 | A1 * | 4/2004 | Juett | 15/1.7 |

FOREIGN PATENT DOCUMENTS

WO WO 0171125 A1 * 9/2001

* cited by examiner

*Primary Examiner* — Joseph J Hail
*Assistant Examiner* — Joel Crandall
(74) *Attorney, Agent, or Firm* — Ronald E. Smith; Smith & Hopen, P.A.

(57) ABSTRACT

A swimming pool brush includes a brush head having a pair of apertures formed in the brush head and a plurality of bristles secured in depending relation to the brush head in surrounding relation to each aperture. A first plurality of clips is formed in a top wall of the brush head on a first side of the apertures. A hydrofoil plate has a first edge adapted to be hingedly engaged by the first plurality of clips, an extended position when the brush head is immersed and pushed downwardly against a swimming pool sidewall and a retracted position when the brush head is pulled upwardly against the sidewall. A venturi effect is created by the plate when in its extended position but the apertures minimize the venturi effect. The plate may be mounted to a second plurality of clips so that the brush head can be reversed and re-used.

10 Claims, 11 Drawing Sheets

SWIMMING POOL BRUSH WITH HYDROFOIL

BACKGROUND OF THE INVENTION

1. Field of the Invention

This invention relates to a swimming pool brush. More particularly, it relates to a swimming pool brush that includes a hydrofoil to enhance the pressure of the brush against the sidewalls of a swimming pool.

2. Description of the Prior Art

Manual tools for brushing the sidewalls of a swimming pool include an elongate pole having a brush releasably secured to a leading end of the pole. The tool is used by grasping the elongate pole away from the leading end and moving the pole up and down so that the brush bears against the sidewall. It is important to apply pressure to the brush to enhance its cleaning effect. The pressure is applied by pushing out on the upper or trailing end of the pole with a first hand while pulling the pole in towards the sidewall with a second hand at a location between the leading and trailing ends. The second hand thus defines a fulcrum where leverage is applied to the brush.

There are several patents disclosing plates attached to a swimming pool brush that increase the pressure of the brush against a swimming pool sidewall so that a user need not exert extra energy to increase such pressure. In some of the prior art patents, the plate is fixedly secured to the brush head and has utility in causing water to push the brush in the direction of the sidewall during a down stroke, thereby increasing the pressure on the brush as desired.

A major drawback of such plates is a vacuum created on the trailing side of the plate as the brush is pushed downwardly. Water flowing upwardly around the edge of the plate creates a venturi effect low pressure area on the trailing side of the plate, thereby lifting the plate away from the sidewall and thus reducing the pressure of the brush against the sidewall. There are no known disclosures of a brush head that minimizes the venturi effect.

Prior art brushes must be discarded when worn down. Thus there is a need for a brush that can still be used even after it would be considered worn out by conventional standards.

The prior art, however, does not disclose brushes that can be re-used even when apparently worn down.

There is a need for an improved swimming pool brush having a hydrofoil that increases the pressure of a brush head against a swimming pool sidewall during a downstroke while simultaneously minimizing the pressure-reducing effects created on the trailing side of the hydrofoil.

A need exists as well for a brush head that wears out on a first side thereof and which is reversibly mounted so that a second side thereof can be used when the first side is worn down.

However, in view of the prior art considered as a whole at the time the present invention was made, it was not obvious to those of ordinary skill in this art how the needed brush assembly could be provided.

SUMMARY OF INVENTION

The long-standing but heretofore unfulfilled need for an improved swimming pool brush is now met by a new, useful, and nonobvious invention. The novel swimming pool brush includes a brush head having a top wall and a bottom wall. At least one aperture is formed in the brush head and a plurality of bristles is secured to the bottom wall in depending relation thereto, in surrounding relation to the at least one aperture.

A first plurality of clips is formed integrally with the top wall on a first side of the at least one aperture. A hydrofoil plate having a first longitudinally-extending edge is adapted to be hingedly engaged by the first plurality of clips. The hydrofoil plate has a first, extended position when the brush head is immersed in water and pushed downwardly against a substantially vertical swimming pool sidewall. The first position is a position of rotational adjustment where the plate is positioned a few degrees above a plane that is substantially perpendicular to the swimming pool side wall.

The hydrofoil plate has a second, retracted position when the brush head is pulled upwardly against a swimming pool sidewall. The second position is a position of rotational adjustment where the plate is positioned in a plane that is substantially parallel to the swimming pool sidewall.

When the plate is in its first position, it is pushed by water in the swimming pool towards the swimming pool sidewall, thereby increasing pressure of the bristles against the sidewall.

The at least one aperture formed in the brush head is operative to reduce a venturi effect created by water flowing over the hydrofoil plate when the hydrofoil plate is in the first position.

The at least one aperture creates a venturi effect that advantageously pushes the bristles away from the swimming pool sidewall when the hydrofoil plate is in the second position.

A semicircular recess is formed in the top wall of the brush head, mid-length thereof. A connector member has a semicircular first end adapted to fit within the semicircular recess. The connector member has a tubular second end adapted to releasably engage an elongate pole. The semicircular first end is mounted for rotation within the semicircular recess so that the connector and hence the elongate pole are attachable to the brush head in an infinite plurality of functional positions of angular adjustment.

In a preferred embodiment, the at least one aperture is a pair of longitudinally-extending apertures disposed on opposite sides of the semicircular recess. The longitudinal axis of the apertures is coincident with a longitudinal axis of the brush head.

A bead is formed along a first longitudinally-extending edge of the hydrofoil plate and a plurality of apertures is formed in the hydrofoil plate adjacent the bead in longitudinally spaced apart relation to one another.

A first plurality of clips is formed in the top wall of the brush head, adjacent a first longitudinal edge thereof, in longitudinally spaced apart relation to one another. A second plurality of clips is also formed in the top wall of the brush head, adjacent a second longitudinal edge thereof, in longitudinally spaced apart relation to one another.

The plurality of apertures formed in the hydrofoil plate includes individual apertures spaced apart from one another to coincide with the spacing between the clips so that the clips releasably engage the bead at longitudinally spaced intervals along its extent. The hydrofoil plate may therefore be hingedly mounted to the brush head along the first or second longitudinal edge thereof. In use, the hydrofoil plate is hingedly attached to the first plurality of clips until the bristles that contact the pool side walls are worn down. The hydrofoil plate is then detached from the first plurality of clips and attached to the second plurality of clips so that unworn bristles will contact the pool side walls.

When the hydrofoil plate is moved from one longitudinal edge of the brush head to the other, the angle of the connector is also reversed so that the elongate pole does not interfere with the hydrofoil plate. More particularly, the brush head has a first position when the hydrofoil plate is secured to the first plurality of clips and has a second position when the hydrofoil plate is secured to the second plurality of clips. The second position is rotated one hundred eighty degrees relative to the first position so that a first edge of the brush bears against swimming pool sidewall when the brush head is in the first position and so that a second edge of the brush bears against a swimming pool sidewall when the brush head is in the second position.

The hydrofoil plate has a first position of rotational adjustment when the brush head is immersed in water and displaced in a downwardly direction in sliding relation to a swimming pool sidewall. The plate, when in said first position, is disposed a few degrees above an imaginary plane that is perpendicular to the swimming pool sidewall. The plate has a second position of rotational adjustment when the brush head is immersed in water and displaced in an upwardly direction in sliding relation to the swimming pool sidewall. The plate, when in said second position, is substantially parallel to the swimming pool sidewall.

Water, when flowing past the plate when the plate is in said first position, pushes the brush head towards the swimming pool sidewall. When flowing past the plate when the plate is in its second position, the water creates a venturi effect that pulls the brush head away from the swimming pool sidewall.

In a second embodiment, a ball and socket joint interconnects the elongate handle and the brush head. The ball and socket joint includes a ball secured to a leading end of the elongate handle and a socket formed integrally with a top wall of the brush head.

The socket has four upstanding arcuate walls adapted to rotatably engage spherical walls of the ball. Each arcuate wall is circumferentially spaced apart from its contiguous walls by a distance substantially equal to a width of the elongate handle so that the elongate handle slideably fits therebetween. A concavity is formed in each wall of said the upstanding arcuate walls of the socket.

The ball is centrally bored and internally threaded. An externally threaded screw is secured to the distal end of the elongate handle and a detent is secured to a distal end of the externally threaded screw. The elongate handle is locked into a preselected position when the detent is seated within a preselected concavity. The detent is seated within a preselected concavity by rotating the handle in a first direction about a longitudinal axis of symmetry of the elongate handle when the elongate handle is positioned in a preselected space between two contiguous arcuate walls. The elongate handle is unlocked by rotating the handle in a second direction opposite to the first direction about the longitudinal axis of symmetry of the elongate handle so that the detent is unseated from the preselected concavity.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
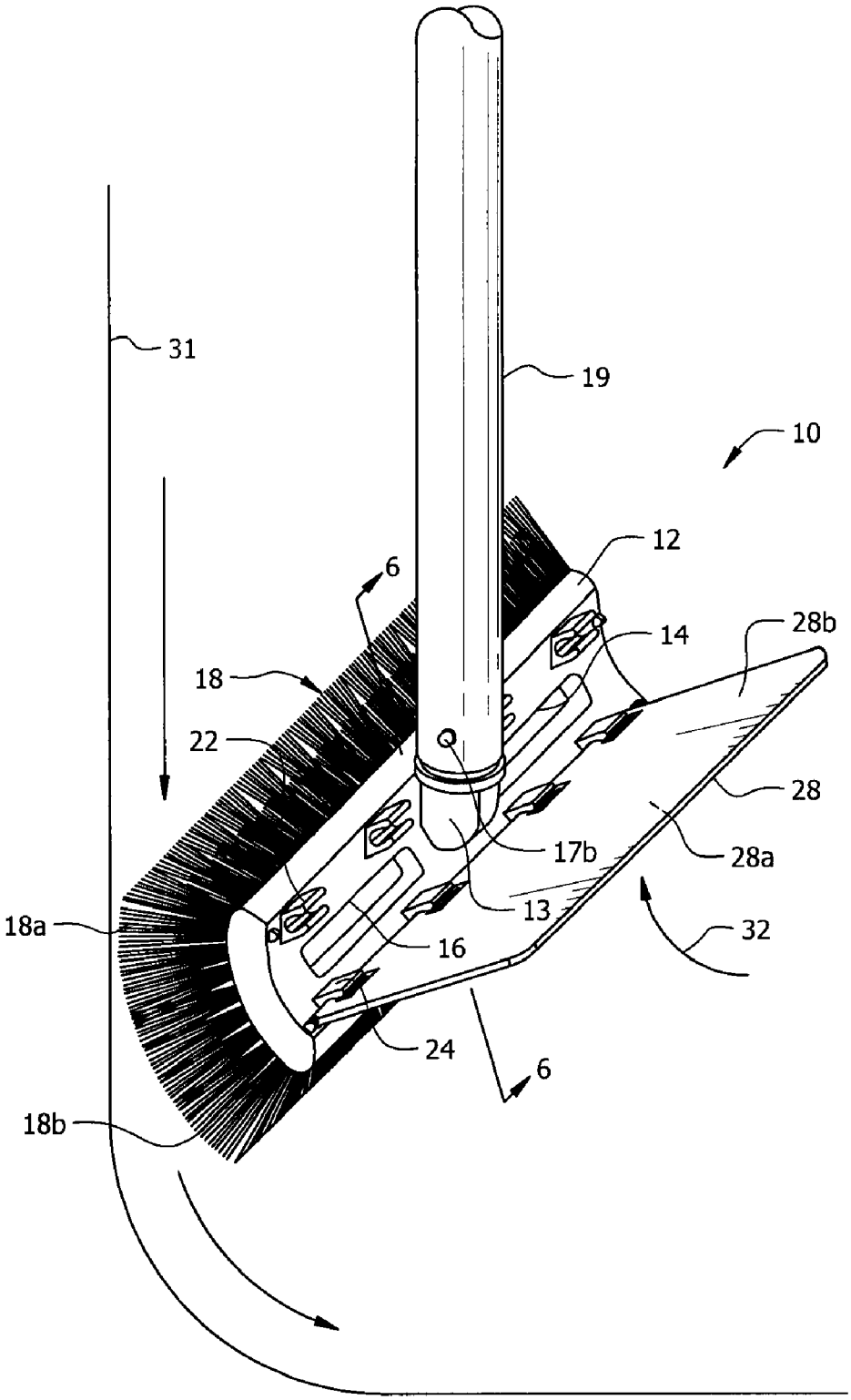
FIG. 1 is a perspective view of the novel brush head as it is being pushed downwardly relative to a swimming pool side wall.

Turning now to FIGS. 1-7, it will there be seen that an illustrative embodiment of the invention is denoted as a whole by the reference numeral 10.

Figure 6:
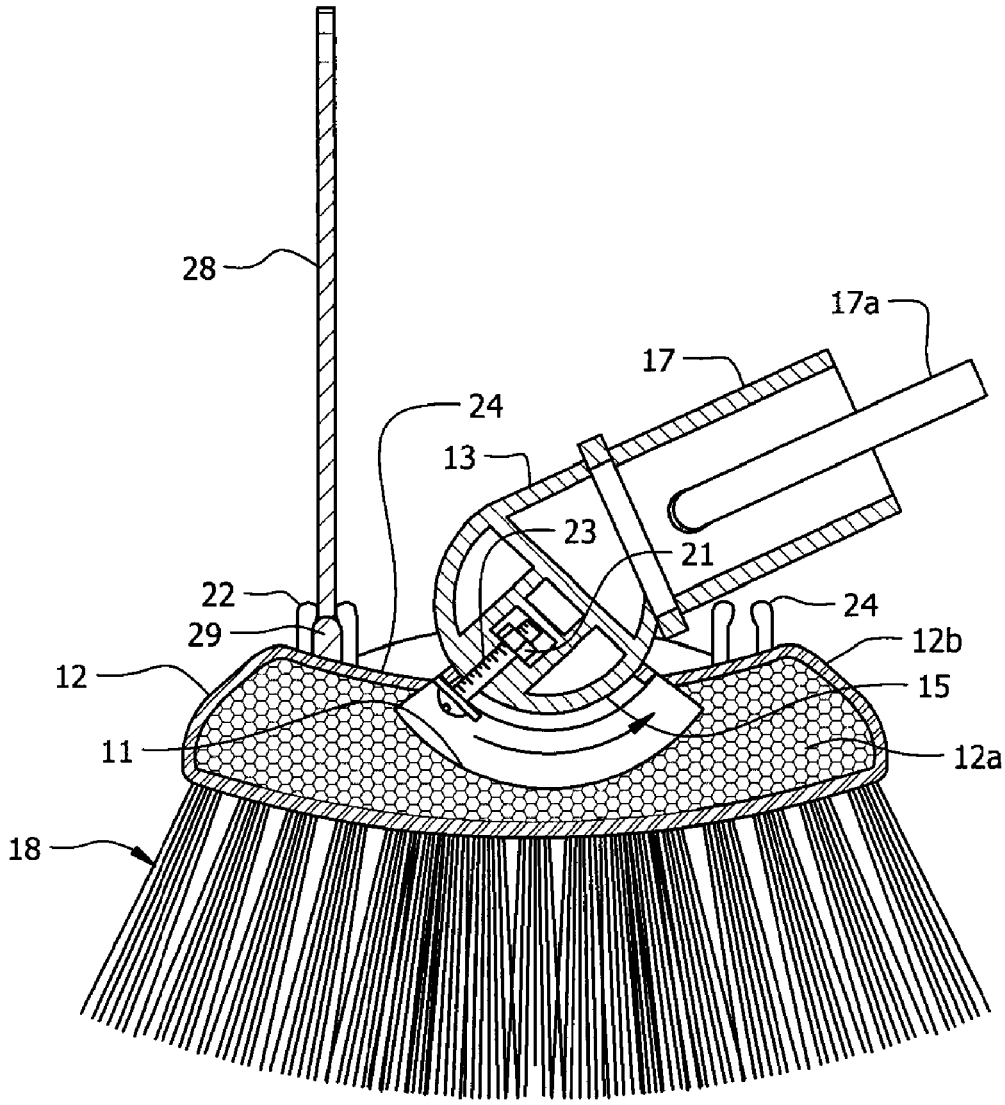
FIG. 6 is a transverse sectional view taken along line 2-2 in FIG. 3.

Brush 10 includes brush head 12 within which is formed longitudinally-extending apertures 14 and 16 positioned on opposite ends of semicircular recess 11 (said recess being depicted in FIG. 6). The longitudinal axis of symmetry of apertures 14 and 16 is coincident with a longitudinal axis of symmetry of brush head 12 and recess 11 is positioned mid-length of brush head 12.

Figure 7:
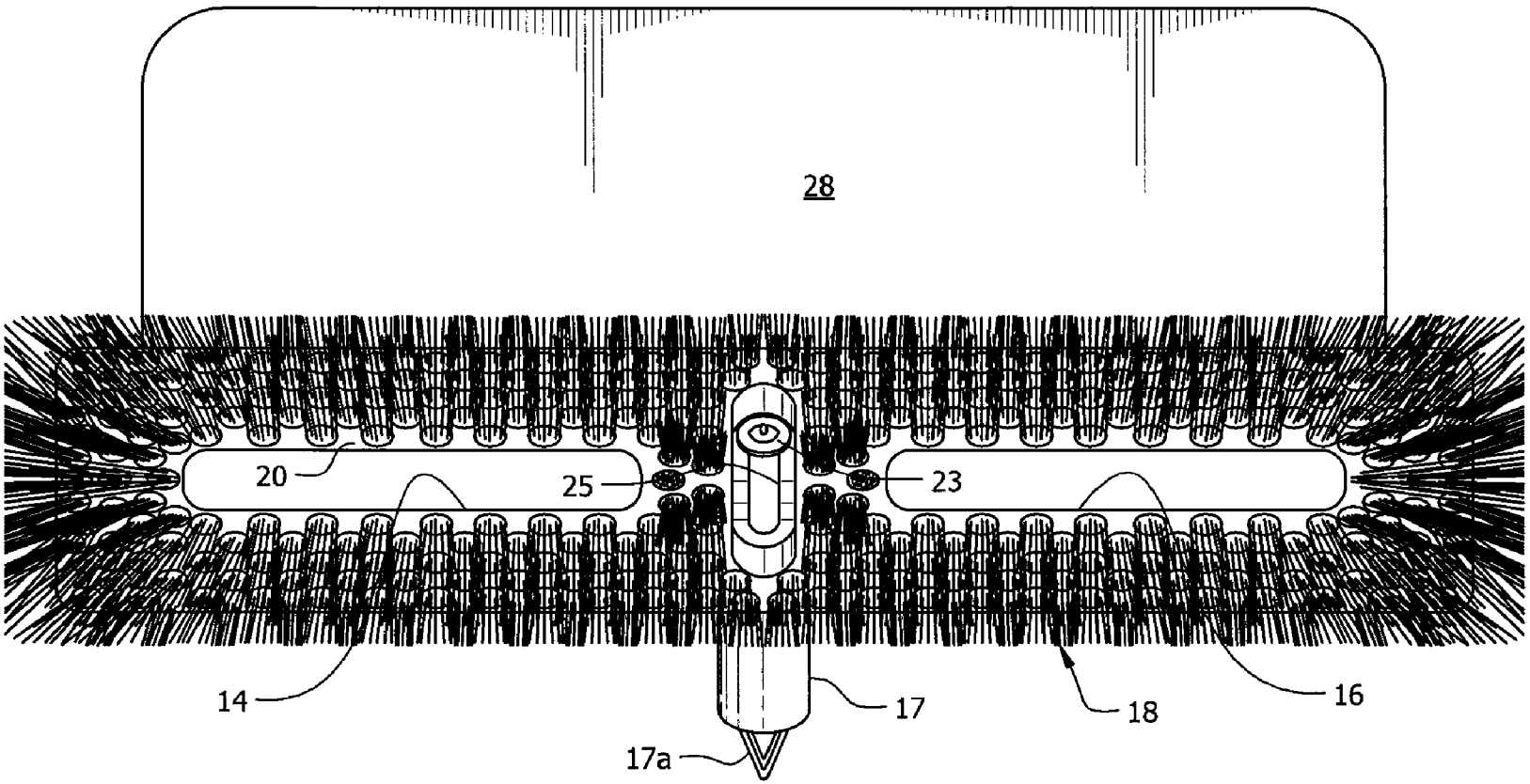
FIG. 7 is a bottom plan view of the novel brush head.

Bristles 18 are secured to and depend from bottom wall 20 of brush head 12 in surrounding relation to said apertures as best understood in connection with FIG. 7. This allows water to flow unobstructed through said apertures when brush head 12 is moving up and down along a swimming pool sidewall. As depicted in FIG. 1, bristles 18*a* are worn down before bristles 18*b* when the novel apparatus is in the FIG. 1 configuration.

Bristles 18 collectively define end flairs 18*c*, 18*d* (FIGS. 4 and 5) that are circumferentially spaced from one another.

Figure 3:
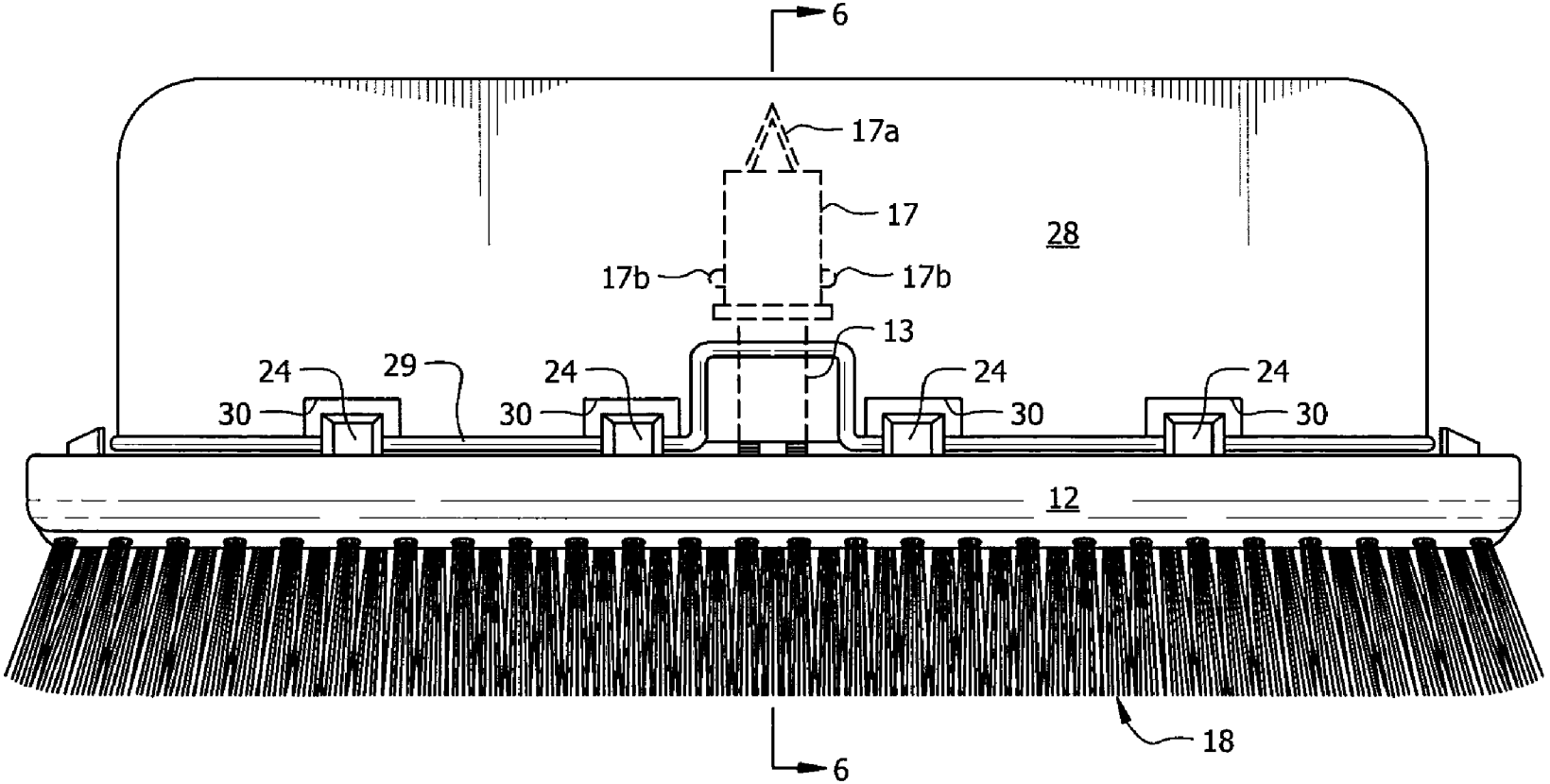
FIG. 3 is a front elevational view of the novel brush.

Connector 13 has a semicircular leading end 15 that fits within semicircular recess 11 as best understood in connection with FIG. 6 and a tubular trailing end 17 that releasably engages elongate pole 19 (FIG. 1), i.e., said tubular trailing end ensleeves the leading end of handle 19. A well-known flexible "V" shaped locking device 17*a* is positioned in the hollow interior of handle 19 and has a bulbous protrusion 17*b* formed in each of its free ends and said protrusions extend through diametrically opposed openings formed in trailing end 17 as depicted in FIG. 3 and through diametrically opposed openings 19*a* formed in the leading end of pole 19 as depicted in FIG. 1 when the locking device is in repose. A user disconnects pole 19 from tubular trailing end 17 by manually pressing on protrusions 17*b* to drive them radially inwardly out of openings 19*a* so that pole 19 may slidingly disengage from tubular trailing end 17.

The mating of semicircular leading end 15 and semicircular recess 11 enables connector 13 to be positioned in an infinite plurality of functional positions of angular adjustment as indicated in FIG. 6. Nut 21 is housed in a confined recess built into brush head 12 and therefore is held against rotation. A blind bore formed in leading end 15 receives screw 23. A semicircular slot 25 (FIG. 7) formed in a bottom side of brush head 12 receives screw 23 so that said screw may be aligned with the blind bore formed in said leading end 15 for any angular position of connector 13. Accordingly, screw 23 engages nut 21 to secure connector 13 to brush head 12 and the angular relation between said connector and brush head may be adjusted to any angle.

A first plurality of clips, collectively denoted 22, is formed integrally with top wall 23 of brush head 12 on a first side of apertures 14 and 16 and a second plurality of clips, collectively denoted 24, is formed integrally with said top wall 23 on a second side of apertures 14 and 16.

As depicted in the transverse sectional view of FIG. 6, brush head 12 has a foam interior 12*a* and a hard polypropylene exterior 12*b*.

Elongate bead 29 (FIG. 3) is formed in hydrofoil plate 28 along a first or inner edge thereof, said bead having a cross-sectional diameter greater than a thickness of plate 28. A plurality of apertures, collectively denoted 30, is formed near said first, inner edge in plate 28 adjacent said bead 29. The individual apertures are spaced apart from one another to coincide with the spacing between clips 22 so that clips 22 may releasably engage bead 29 at spaced intervals along its extent. Clips 22 and 24 and apertures 30 are equidistantly spaced apart in the preferred embodiment, but such equidistant spacing is not critical. The clipped connection is a pivotal or hinged connection because plate 28 is free to swing between its depicted FIG. 1 and FIG. 2 positions as a user oscillates brush head 12 up and down pool sidewall 11.

When a user displaces brush head 12 in a downwardly direction, as illustrated in FIG. 1, the resistance of the water pushes plate 28 into its FIG. 1 position. Plate 28 is positioned in a plane that is substantially perpendicular to vertical sidewall 31 of the swimming pool. More particularly, plate 28 is positioned a few degrees above a plane that is perpendicular to said vertical sidewall. The relative motion of water with respect to plate 28 is denoted by directional arrow 32. Water on the lower side 28*a* of plate 28 thus pushes said plate and said brush head towards pool sidewall 31. Water flowing around plate 28 creates a venturi effect, i.e., a low pressure area above top surface 28*b* of plate 28, i.e., on the trailing side of said plate as it is pushed downwardly. In the absence of longitudinal apertures 14 and 16, this venturi effect would reduce the force directed towards pool sidewall 31. However, apertures 14 and 16 allow water flowing around plate 28 to flow through said apertures 14, 16, thereby reducing the venturi effect and maximizing the pressure applied to the bristles as they are pushed downwardly.

Figure 2:
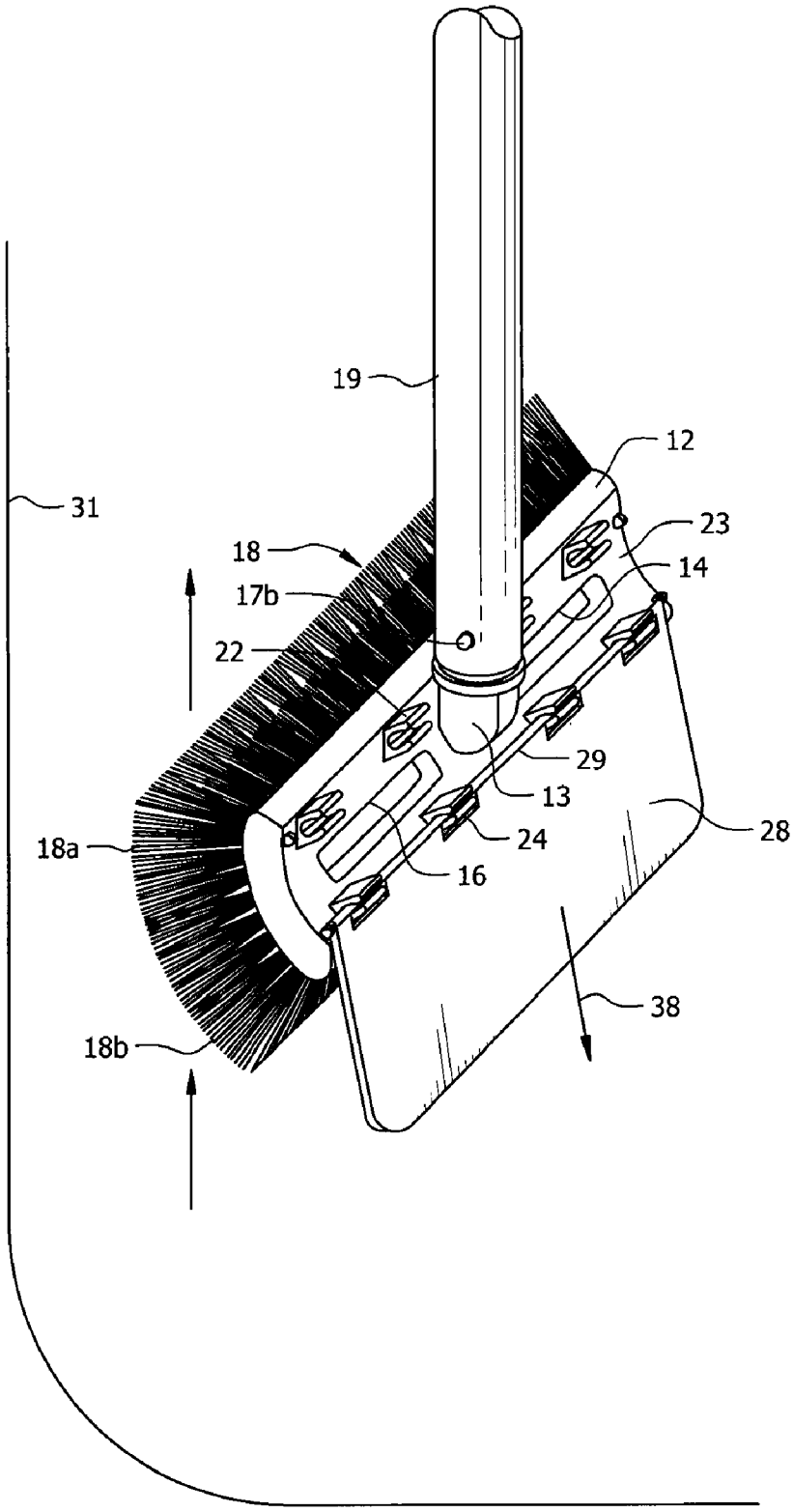
FIG. 2 is a perspective view of the novel brush head as it is being pulled upwardly relative to a swimming pool side wall.

When the user displaces brush head 12 in an upwardly direction, as illustrated in FIG. 2, the resistance of the water causes plate 28 to pivot about its hinged connection to brush head 12 until it lies in a plane that is substantially parallel to sidewall 31. When so positioned, plate 28 causes almost no resistance as the user pulls upwardly on pole 19 to which brush head 12 is secured. Water flowing in the relative direction indicated by directional arrow 38 creates a venturi effect as it flows past each aperture 14, 16, thereby creating a low pressure area that lifts the brush head away from sidewall 31 to further reduce the energy expended by the user in performing the upward, non-cleaning stroke.

In this way, apertures 14 and 16 in brush head 12 offset a first venturi effect during its downward cleaning stroke that enhances the pressure of the bristles against sidewall 31 and a second venturi effect that reduces the pressure of the bristles against sidewall 31 during its upward, non-cleaning stroke.

Figure 4:
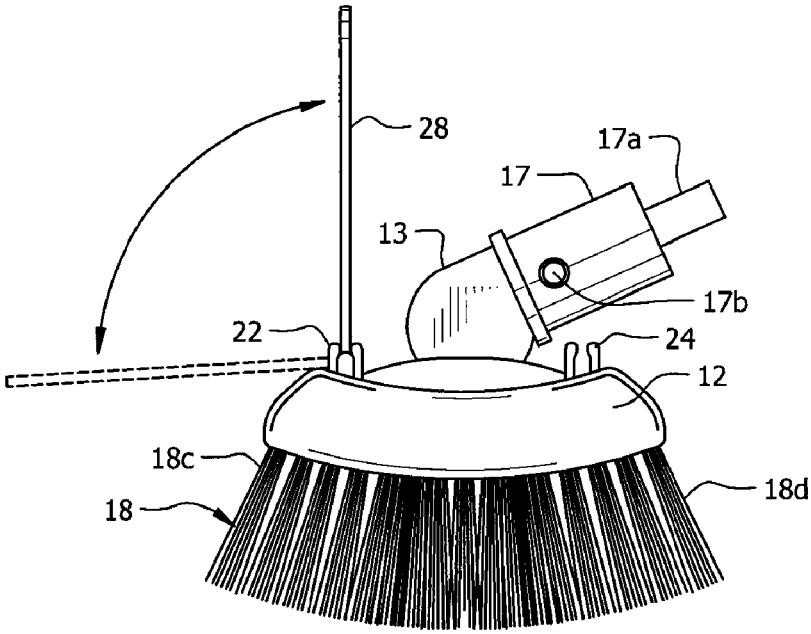
FIG. 4 is an end view of the novel brush head when the novel hydrofoil plate is attached to the first plurality of clips.
Figure 5:
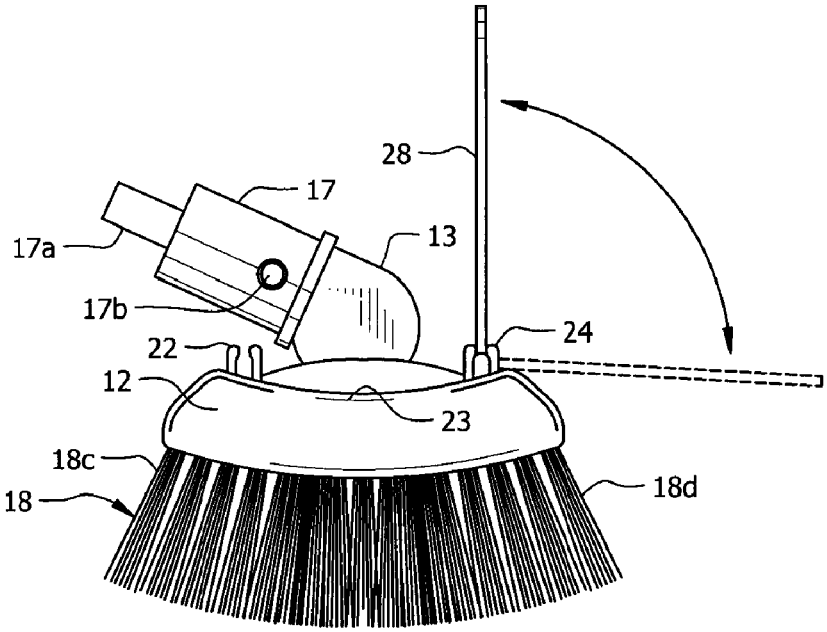
FIG. 5 is an end view of the novel brush head when the novel hydrofoil plate is attached to the second plurality of clips.

It will be noted from an inspection of FIGS. 1 and 2 that brush 12 will wear primarily along upper edge 18*a* because said upper edge will bear hardest against sidewall 31 when the brush is in use. To reverse the brush, plate 28 is unclipped from clips 22 and re-positioned to the opposite side of the brush head so that it can be clipped to clips 24 as indicated in FIGS. 4 and 5. This requires loosening and re-tightening of connector 13. Screw 23 is loosened, hydrofoil plate 28 is re-positioned from its FIG. 4 to its FIG. 5 position, connector 13 is re-positioned from its FIG. 4 to its FIG. 5 position, and screw 23 is re-tightened to nut 21 to secure connector 13 into its new position. The brush is then used as before but a new side 18*b* now bears against pool sidewall 31.

FIGS. 8-13 depict a second embodiment where handle 19 is connected to brush head 12 in four (4) distinct and locked positions by a ball and socket joint. In the depicted embodiment, tubular housing 17 is an adaptor that ensleeves the leading end of handle 19 and said adaptor directly engages the ball. However, in an undepicted embodiment, tubular housing 17 could be eliminated and the leading end of handle 19 could directly engage the ball.

Figure 8:
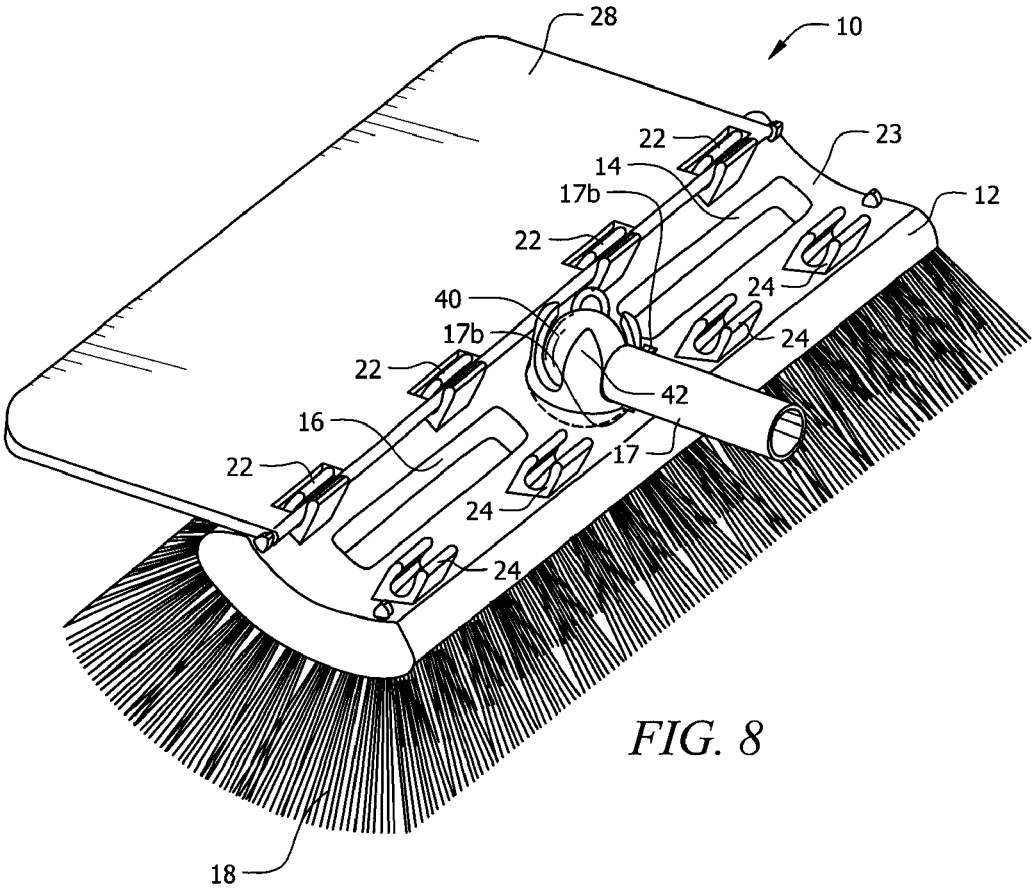
FIG. 8 is a perspective view of a second embodiment of the novel brush head having a ball and socket connection between the handle and the brush head and depicting the handle in a first position of four possible positions provided by said ball and socket connection.
Figure 10:
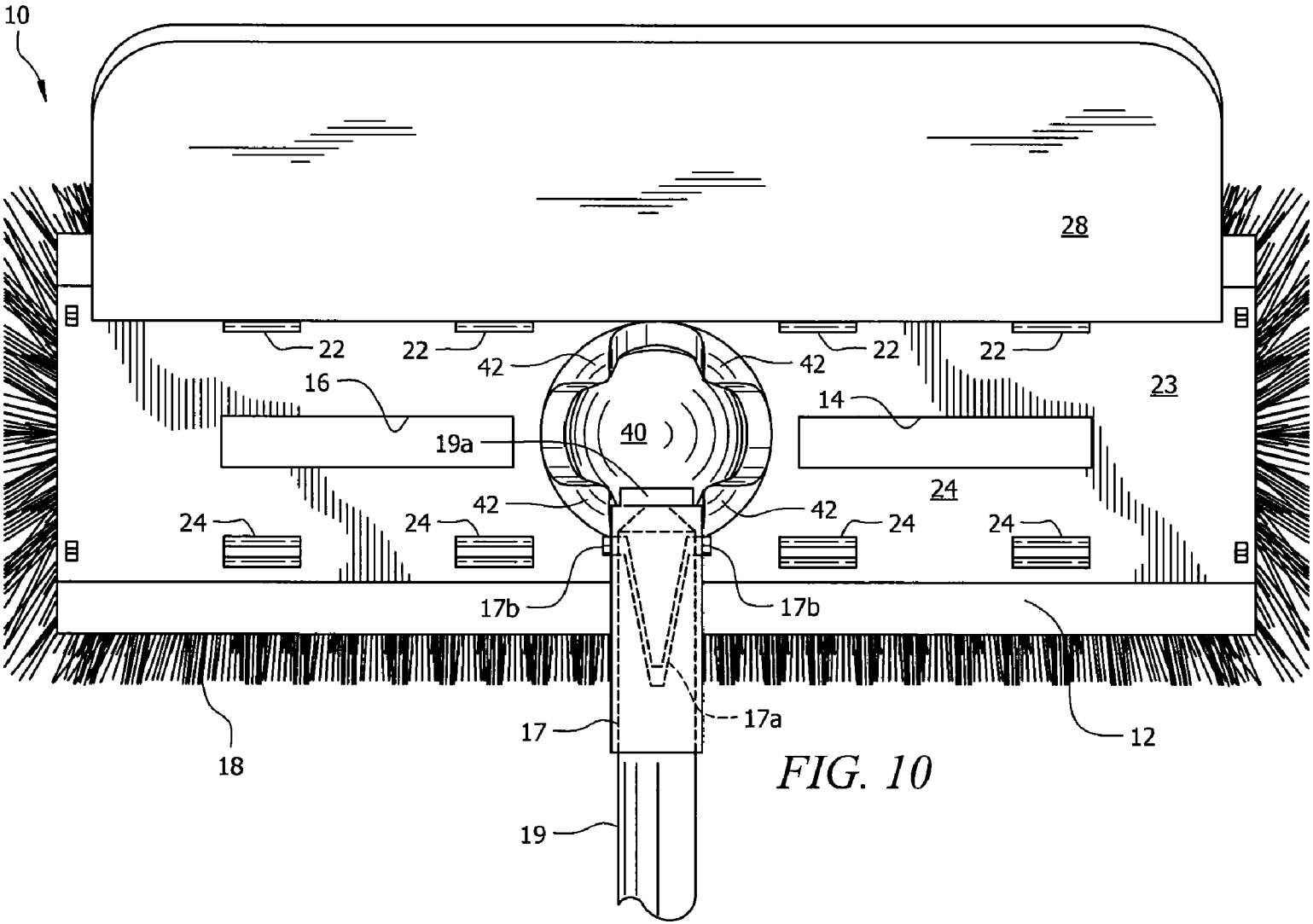
FIG. 10 is a top plan view of the structure depicted in FIG. 8; and depicting the handle in a second position of said four possible positions.
Figure 11:
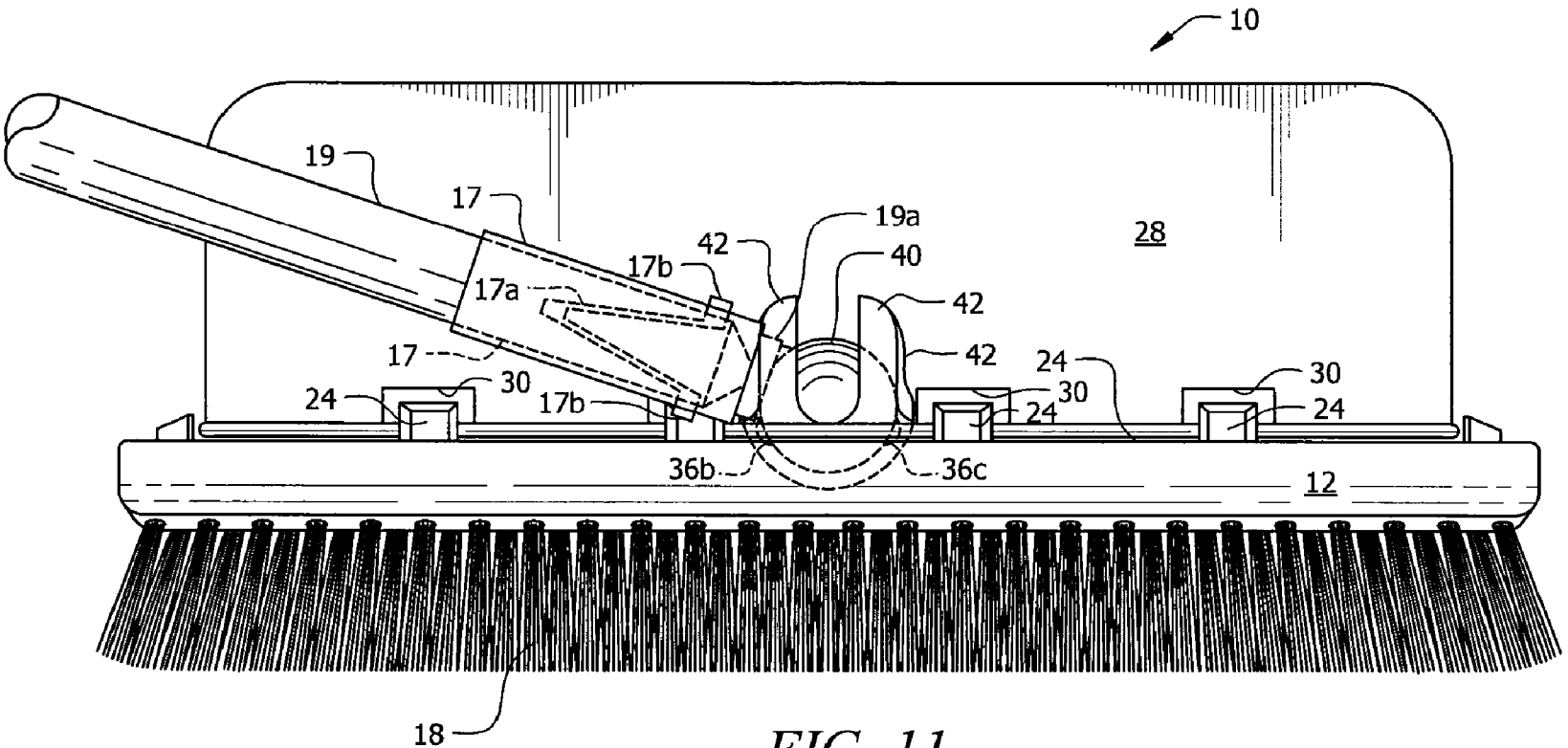
FIG. 11 is a front elevational view of the structure depicted in FIG. 8, depicting the handle in a second position of said four possible positions.
Figure 12:
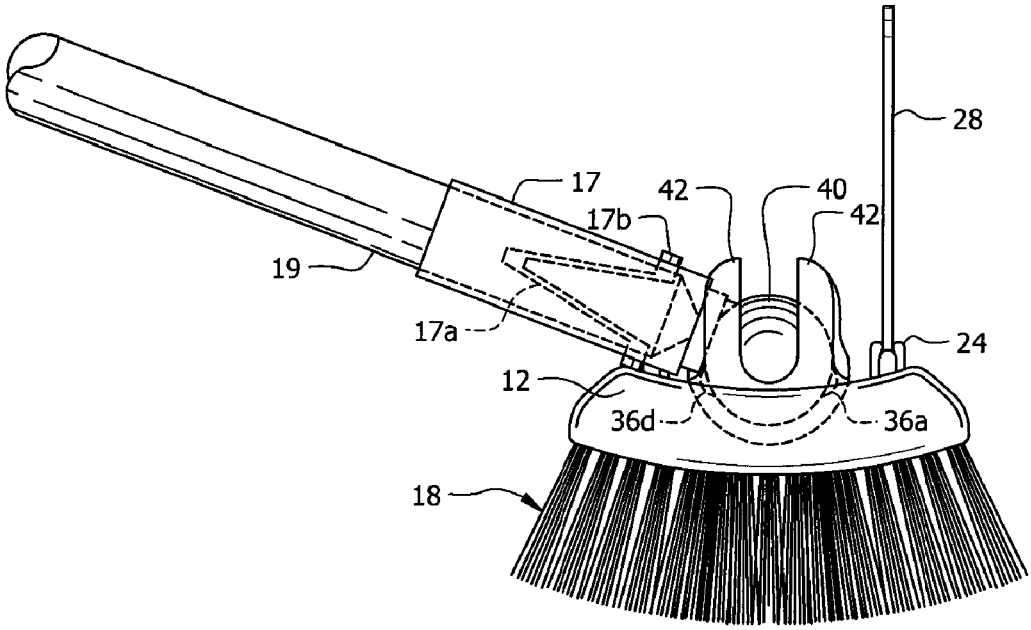
FIG. 12 is an end elevational view of the novel brush head when in its FIG. 8 configuration.
Figure 13:
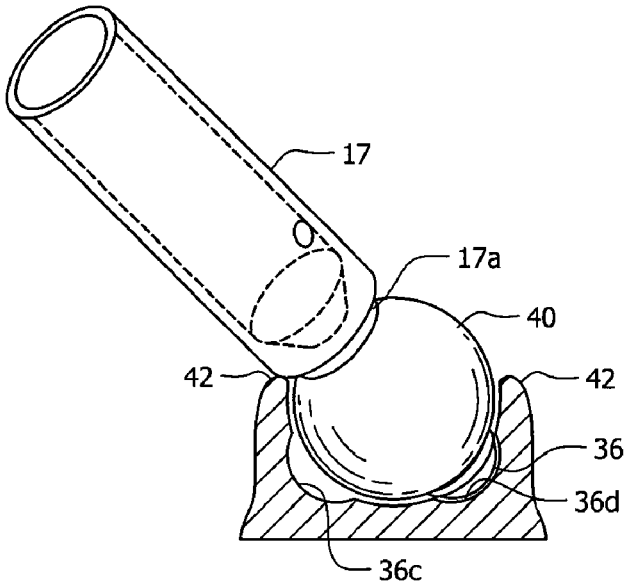
FIG. 13 is a sectional view depicting the detent of the ball positioned within a concavity formed in the socket.

The first of said four (4) locked positions is depicted in FIGS. 8 and 10. Handle 19 is perpendicular to the longitudinal axis of symmetry of brush head 12. The second of said four (4) locked positions is not depicted but it also positions handle 19 perpendicular to said longitudinal axis of symmetry in diametrically opposed relation to the position depicted in FIGS. 8 and 10. In other words, handle 19 extends downwardly from brush head 12 as drawn in FIG. 8 and it would extend upwardly in said second position. FIG. 11 depicts the third of said four locked (4) positions. Handle 19 extends to the left as drawn in parallel relation to the longitudinal axis of symmetry of brush head 12. The fourth locked position would look like FIG. 11 except that handle 19 would extend to the right as drawn.

In the depicted embodiment, tubular housing 17 has a boss 17*a* secured to its leading end and said boss supports externally threaded screw 34 having a rounded detent 36 (FIG. 9A) formed in the leading end of said screw 34. Internally threaded bore 38 is formed in and extends diametrically through ball 40. Rotation of handle 19 in a clockwise direction causes rotation of tubular housing 17 and thus of screw 34 so that said screw is advanced into bore 38. Counter rotation of said handle effects retraction of screw 34 from said bore.

Ball 40 is rotatably captured within socket 42 that is formed integrally with a recess formed in top wall 23 of brush head 12. Socket 42 includes four (4) arcuate walls, collectively denoted 42, that extend above the plane of top wall 23. The four (4) arcuate walls are circumferentially spaced apart from one another to provide four (4) slots, each of which accommodates tubular housing 17 when handle 19 is in one of its four (4) locked positions. A detent-receiving concavity is formed in each of the four (4) arcuate walls, on an interior surface thereof, and each concavity receives detent 36 when handle 19 is positioned in one of its four locked positions. The concavities are denoted 36*a*, 36*b*, 36*c*, and 36*d* in FIG. 9B.

A user positions handle 19 in one of its four (4) positions to align detent 42 with an associated concavity and then rotates handle 19 clockwise (assuming that threads 34 are right-handed) to advance detent 42 fully into its associated concavity so that the detent is locked in said concavity when handle 19 can no longer be rotated in said clockwise direction under manual power. This assures that handle 19 remains in its selected locked position as the pool is scrubbed. When the user desires to re-position handle 19 into another one of its four locked positions, handle 19 is rotated counterclockwise until detent 36 withdraws from its concavity, thereby freeing rotational movement of ball 40 so that handle 19 can be placed into another one of the four (4) slots defined by the four arcuate walls 42 of the ball-capturing socket. It is then retightened by rotating the handle in the clockwise direction, with detent 36 advancing into a different one of the concavities to perform the locking function.

A ball and socket similar to the novel ball and socket is disclosed in U.S. Pat. No. 5,551,115 to the present inventor. That earlier structure did not include detent 36 or detent-receiving concavities.

Figure 9A:
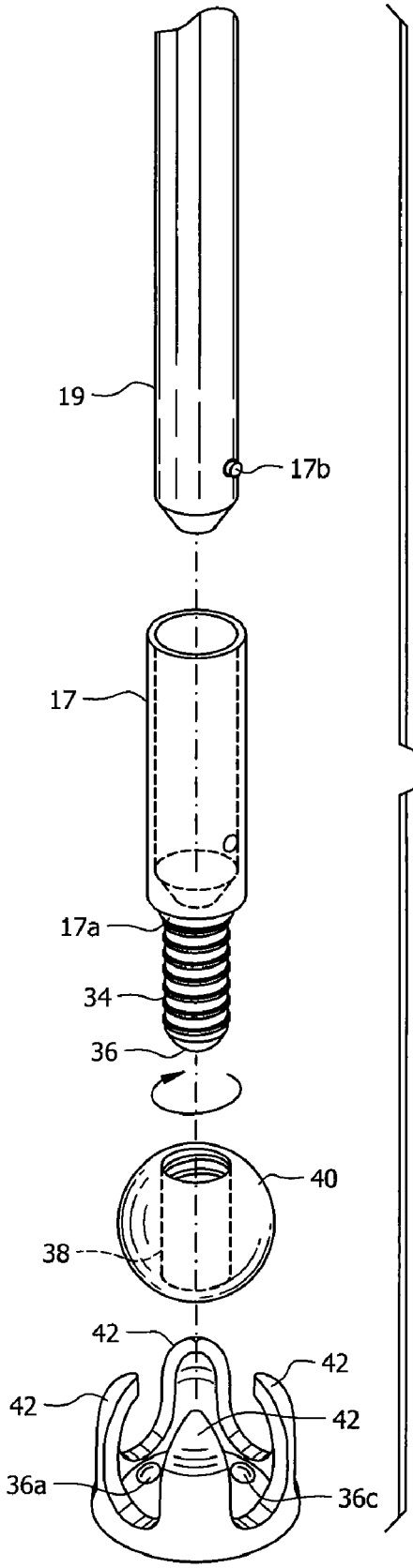
FIG. 9A is an exploded view of the ball and socket assembly.
Figure 9B:
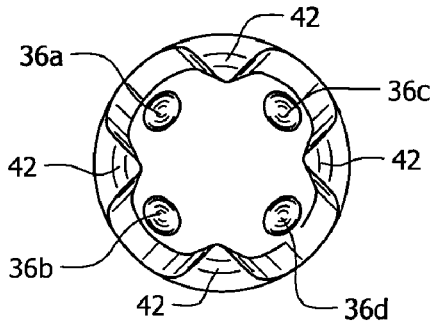
FIG. 9B is a top plan view of the novel socket.

It should be understood from FIG. 9A that if it were desired to eliminate tubular housing 17, screw 34 would be secured to the leading end of handle 19 so that said screw 34 could directly engage internally threaded bore 38 formed in ball 40. The depicted embodiment including adaptor 17 is preferred so that pool owners may purchase the novel brush head and use it with their existing conventional handle 19.

It will be thus seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A swimming pool brush, comprising:

a brush head having a top wall and a bottom wall;

an elongate handle having a leading end adapted to engage said brush head and a proximal end adapted to be engaged by a user of said swimming pool brush;

at least one aperture formed in said brush head;

a plurality of bristles secured to said bottom wall in depending relation thereto and in surrounding relation to said at least one aperture;

a first plurality of clips formed integrally with said top wall on a first side of said at least one aperture;

a second plurality of clips formed integrally with said top wall on a second side of said at least one aperture;

a hydrofoil plate having a first longitudinally-extending edge adapted to be selectively hingedly engaged by said first plurality of clips or said second plurality of clips;

said hydrofoil plate having a first, extended position when said brush head is immersed in water and pushed downwardly against a substantially vertical swimming pool sidewall;

said first position being a position of rotational adjustment where said hydrofoil plate is positioned in a plane that is substantially perpendicular to said swimming pool side wall;

said hydrofoil plate having a second, retracted position when said brush head is pulled upwardly against a swimming pool sidewall;

said second position being a position of rotational adjustment where said hydrofoil plate is positioned in a plane that is substantially parallel to said swimming pool sidewall;

said hydrofoil plate, when in said first position, being pushed by water in said swimming pool towards said swimming pool sidewall, thereby increasing pressure of said bristles against said sidewall;

said at least one aperture being operative to reduce a venturi effect created by water flowing over said hydrofoil plate when said hydrofoil plate is in said first position;

said at least one aperture, when said hydrofoil plate is in said second position, creating a venturi effect that pushes said bristles away from said swimming pool sidewall.

2. The swimming pool brush of claim 1, further comprising:

a semicircular recess formed in said top wall of said brush head, mid-length of said brush head;

a connector member having a semicircular first end adapted to fit within said semicircular recess;

said connector member having a tubular second end adapted to releasably engage an elongate pole;

said semicircular first end being mounted for rotation within said semicircular recess so that said connector is attachable to said brush head in an infinite plurality of functional positions of angular adjustment.

3. The swimming pool brush of claim 2, further comprising:

said at least one aperture being a pair of longitudinally-extending apertures disposed on opposite sides of said semicircular recess.

4. The swimming pool brush of claim 2, further comprising:

said connector having a first position of rotational adjustment when said hydrofoil plate is hingedly secured to said first plurality of clips;

said connector having a second position of rotational adjustment when said hydrofoil plate is hingedly secured to said second plurality of clips;

said brush head having a first position when said hydrofoil plate is secured to said first plurality of clips;

said brush head having a second position when said hydrofoil plate is secured to said second plurality of clips;

said second position being rotated one hundred eighty degrees relative to said first position;

whereby a first edge of said brush bears against said swimming pool sidewall when said brush head is in said first position; and whereby a second edge of said brush bears against said swimming pool sidewall when said brush head is in said second position.

5. The swimming pool brush of claim 1, further comprising:

a bead formed along a first longitudinally-extending edge of said hydrofoil plate;

a plurality of apertures formed in said hydrofoil plate adjacent said bead in longitudinally spaced apart relation to one another;

said plurality of apertures formed in said hydrofoil plate enabling selective releasable attachment of said hydrofoil plate to said first plurality of clips or to said second plurality of clips so that said hydrofoil plate is selectively hingedly mounted to said brush head on said first side of said at least one aperture or said second side of said at least one aperture.

6. The swimming pool brush of claim 1, further comprising:

an elongate handle;

a ball and socket joint for interconnecting said elongate handle and said brush head.

7. The swimming pool brush of claim 6, further comprising:

said ball and socket joint including a ball secured to said leading end of said handle;

said ball and socket joint including a socket formed integrally with a top wall of said brush head;

said socket having four upstanding arcuate walls adapted to rotatably engage spherical walls of said ball;

each arcuate wall being circumferentially spaced apart from a contiguous arcuate wall by a distance substantially equal to a width of said elongate handle so that said elongate handle may slideably fit therebetween.

8. The swimming pool brush of claim 7, further comprising:

a concavity formed in each wall of said four upstanding arcuate walls of said socket;

said ball being centrally bored and internally threaded;

an adaptor for securing said externally threaded screw to said distal end of said elongate handle; and a detent secured to a distal end of said externally threaded screw;

whereby said elongate handle is locked into a preselected position when said detent is seated within a preselected concavity;

whereby said detent is seated within a preselected concavity by rotating said handle in a first direction about a longitudinal axis of symmetry of the elongate handle when said elongate handle is positioned in a preselected space between two contiguous arcuate walls; and whereby said elongate handle is unlocked by rotating said handle in a second direction opposite to said first direction about said longitudinal axis of symmetry of the elongate handle so that said detent is unseated from said preselected concavity.

9. The swimming pool brush of claim 8, further comprising:

said adaptor being a tubular housing adapted to ensleeve and releasably engage a leading end of said handle;

said externally threaded screw being secured to a leading end of said tubular housing.

10. The swimming pool brush of claim 7, further comprising:

a concavity formed in each wall of said four upstanding arcuate walls of said socket;

said ball being centrally bored and internally threaded;

said externally threaded screw secured to said distal end of said elongate handle; and a detent secured to a distal end of said externally threaded screw;

whereby said elongate handle is locked into a preselected position when said detent is seated within a preselected concavity;

whereby said detent is seated within a preselected concavity by rotating said handle in a first direction about a longitudinal axis of symmetry of the elongate handle when said elongate handle is positioned in a preselected space between two contiguous arcuate walls; and whereby said elongate handle is unlocked by rotating said handle in a second direction opposite to said first direction about said longitudinal axis of symmetry of the elongate handle so that said detent is unseated from said preselected concavity.

* * * * *